United States Patent [19]

Rickard

[11] 4,025,804

[45] May 24, 1977

[54] MICROWAVE OVEN CONTROL WITH MECHANICAL SWITCH LOCK-OUT

[75] Inventor: Jimmy R. Rickard, Mansfield, Ohio

[73] Assignee: The Tappan Company, Mansfield, Ohio

[22] Filed: Nov. 13, 1975

[21] Appl. No.: 631,684

[52] U.S. Cl. ..... 307/141; 219/10.55 B

[51] Int. Cl.[2] ..... H01H 43/00

[58] Field of Search ..... 307/141, 141.4, 141.8; 200/38 R, 38 A, 38 F, 38 FB, 38 B, 38 BA, 38 C, 38 CA, 38 D, 38 DA, 38 DB, , 38 DC, 38 E, 39 R, 39 A; 219/10.55 R, 10.55 A, 10.55 B, 10.55 C, 10.55 D, 10.55 E, 10.55 F, 10.55 M

[56] References Cited

UNITED STATES PATENTS

| | | | |
|---|---|---|---|
| 3,694,608 | 9/1972 | Loubert et al. | 219/10.55 B |
| 3,738,178 | 6/1973 | Marquis et al. | 200/38 E |
| 3,824,365 | 7/1974 | Tapper | 200/38 FA X |
| 3,842,233 | 10/1974 | Lamb | 219/10.55 B |

*Primary Examiner*—Robert K. Schaefer

*Assistant Examiner*—Morris Ginsburg

*Attorney, Agent, or Firm*—Donnelly, Maky, Renner & Otto

[57] ABSTRACT

An electrical circuit provides continuous or intermittent energization of an electric apparatus, such as a magnetron that generates microwave energy for use in in a microwave oven or the like. When continuously energized the magnetron produces a maximum power output, for example, to cook a food load in the microwave oven; and when intermittently energized the magnetron produces a lower average microwave energy power level to cook food at a relatively slower rate and/or to defrost frozen food efficiently without cooking the outer surface thereof, as the brief off time during each complete cycle of the intermittently energized magnetron allows some temperature equilibration through the food product. The electrical circuit includes a cycling switch mechanism for such intermittent energization of the magnetron and a mechanical lock-out for biasing the switch mechanism to supply continuous energy to the magnetron.

15 Claims, 6 Drawing Figures

MICROWAVE OVEN CONTROL WITH MECHANICAL SWITCH LOCK-OUT

BACKGROUND OF THE INVENTION

The present invention is directed to electrical circuits selectively controlled to produce continuous and intermittent outputs, and, more particularly, the present invention is directed to such electrical circuits used to effect continuous or intermittent energization of the magnetron employed to supply microwave energy to a microwave oven or the like.

In a microwave oven food may be cooked by microwave energy generated by a magnetron or the like in a short time relative to the time normally required to cook the same food in a conventional gas or electric cooking appliance. A microwave oven also may be employed to defrost frozen food, but it has been found desirable when defrosting frozen food to operate the microwave oven intermittently or cyclically so as to avoid cooking the outer layers of the food load before the core thereof has fully thawed. Such intermittent or cyclical energization of a magnetron in a microwave oven is shown in U.S. Pat. Nos. 3,842,233, 3,824,365, and 3,694,608. During such cylical energization of the magnetron the average power level of the microwave energy generated thereby is reduced, and in the off period during each complete cycle the temperatue of the food load in the microwave oven will, to an extent, equilibrate, thus helping to avoid excessive temperatures at the surface of the food load while speeding the thawing process at the core. The same cyclical energization of the magnetron may also be advantageously used to cook certain foods at a relatively slower rate.

SUMMARY OF THE INVENTION

In the present invention a selectively operable electric circuit provides continuous or intermittent energization of an electric apparatus coupled thereto, the electric apparatus in the preferred embodiment being a magnetron of a microwave oven, although it is intended that the circuit and selective means therefore in the present invention may be employed for energizing other electric apparatus as well. The circuit includes a cyclically driven switch mechanism through which electric power is provided intermittently to the electric apparatus, and a selectively actuable means may be actuated to lock the normally cycling switch mechanism in a continuously closed condition to provide a continuous supply of electric energy to the electric apparatus. In a preferred form of the invention the electric circuit supplies energy to a magnetron or the like so that upon continuous energization of the magnetron food may be cooked in the oven and upon intermittent energization of the magnetron frozen food may be thawed or defrosted food may be cooked at a relatively slow rate.

The cyclically driven switch mechanism may be one or more mechanical switches, each having its actuator moved cyclically to opened and closed positions by a motor driven cam. The selectively acutable means, then, may be a further manually actuable cam or the like actuable to move the switch actuators to closed condition for continuous energization of the magnetron or other electric apparatus regardless of the angular or linear position of the cycling motor driven cam. Several arrangements for the cycling and selectively actuable cams are disclosed hereinbelow. In an alternative form of the invention, the cycling cam may be driven by its motor via a clutch connection, and the selectively actuable means, then, may be a stop for the cycling cam for locking the latter in a fixed angular position to maintain the switch mechanism closed while simply slipping against the clutch connection to the motor.

Additionally, the electric circuit may include means for limiting power surges and voltage spikes during initial starting of the circuit and during each intermittent starting of the magnetron when energized in cyclical mode. Moreover, since the time required for cooking or defrosting a food load in a microwave oven is so reduced relative to the time required for the same operation in a conventional gas or electric cooking appliance, it is desirable to include a timer in the energization circuit for accurately controlling the cooking or defrosing period in the microwave oven.

With the foregoing in mind, it is a primary object of the invention to provide an electric circuit improved in the noted respects.

Another object of the invention is to provide an energization circuit for selectively effecting continuous and intermittent energization of an electric apparatus, such as a magnetron in a microwave oven, preferably to effect cooking and defrosting functions, respectively, therein.

An additional object of the invention is to lockout or to bias a cycling switch mechanism to maintain the switch mechanism closed for providing a continuous current path therethrough.

A further object of the invention is to mechanically lock a cycling switch mechanism to a closed switch condition.

These and other objects and advantages of the present invention will become more apparent as the following description proceeds.

To the accomplishment of the foregoing and related ends, the invention, then, comprises the features hereinafter particularly pointed out and distinctly claimed in the claims, the following description and the annexed drawing setting forth in detail certain illustrative embodiments of the invention, these being indicative, however, of but a few of the various ways in which the principles of the invention may be employed.

DESCRIPTION OF THE PREFERRED EMBODIMENTS

Figure 1:
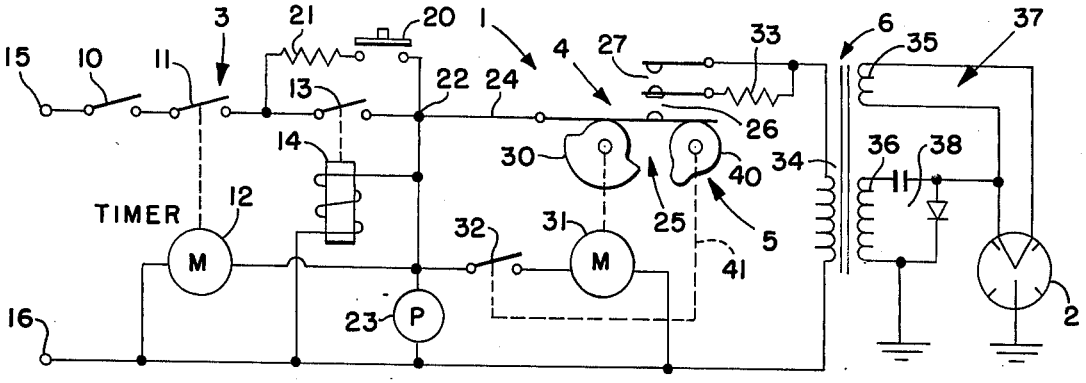
FIG. 1 is a schematic electric circuit diagram of the electric circuit of the invention.

Referring now more specifically to the drawings, wherein like reference numerals designate like elements in the several figures, an electric energization circuit is generally designated at 1 in FIG. 1 for supplying electric power to a magnetron 2 that generates microwave energy for use in a microwave oven, now shown. The circuit 1 includes an on-off control portion 3 and an intermittent operating portion 4 with a selectively actuable means 5 for controlling the circuit 1 to provide continuous or intermittent energization of the magnetron via a circuit coupling portion 6.

In the on-off control portion 3 a power on-off switch 10, a timer switch 11 operated by a conventional timer motor 12, and a hold switch 13 operated by a conventional solenoid 14 control the supply of electric power provided at the circuit input terminals 15, 16, for example, from the utility company, to the intermittent operating portion 4 and the coupling portion 6 of the circuit 1. Although it is schematically illustrated as a singular switch, the power on-off switch 10 may in fact include a fuse, a single pole, single throw on-off switch, a door switch responsive to whether or not the microwave oven door is closed, a latch switch responsive to whether or not the microwave oven door is securely latched in closed position, etc., as is disclosed, for example, in U.S. Pat. No. 3,842,233. Connected in parallel across the hold switch 13 is a push-button start switch 20 which is desirably in series connection with a current limiting resistor 21, for example, a 5 ohm resistor.

To energize the circuit 1 the power on-off switch 10 is closed, the timer is set for the total desired cooking duration whereby the timer switch 11 is closed, and the push-button start switch 20 is pressed to supply electric power to the node junction 22. From the node junction 22 power is distributed to the timer motor 12, which commences timing the total duration of circuit energization; to the solenoid 14, which closes the hold switch 13 maintaining the same closed after the push-button start switch 20 is released until the timer expires opening the timer switch 11; to the intermittent operating portion 4, which supplies power on to the magnetron 2 via the coupling portion 6; and to a conventional pilot light 23 or other suitable signal device which signals that the circuit 1 is presently energized. An on-off control portion of this same general type is also disclosed in U.S. Pat. No. 3,842,233.

Figure 2:
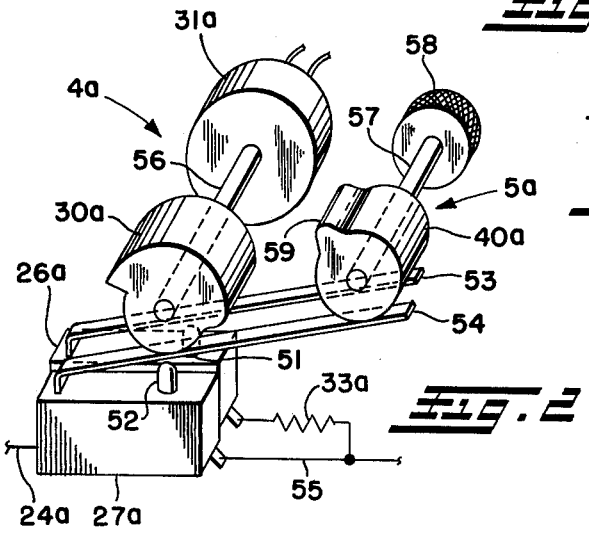
FIG. 2 is an isometric view of a cyclically driven switch mechanism and a mechanical lock-out for locking the switch mechanism in continuously closed condition for use in the circuit of FIG. 1.

In the intermittent operating portion 4 electric power at the node junction 22 is supplied on a line 24 to a mechanical switch mechanism 25, which includes a pair of switches 26, 27 having respsective pairs of normally open contacts mounted, for example, in a "double upper" configuration. The switches 26, 27, which also may be in the form of two single pole single throw switches as shown, for example, at 26*a*, 27*a* in FIG. 2, are normally cyclically driven or moved by a cam 30, which is rotated by a motor 31 receiving power from the node junction 22 via a normally closed switch 32. In a preferred embodiment of the invention the switch mechanism 25 is cyclically driven such that the switch 26 is first closed by the rotating cam 30 to supply electric power via a current limiting resistor 33, for example, on the order of about 5 ohms, to the circuit coupling portion 6 and shortly afterwards the switch 27 is closed, while the contacts of the switch 26 remain closed, to supply full power to the circuit coupling portion 6 and, thus, the magnetron 2.

Assuming that the on-off control portion 3 is energized to supply electric power at the node junction 22, rotation of the cam 30 to close the switch 26 will cause electric power to be provided via the current limiting resistor 33 to the primary winding of a coupling transformer 34 in the circuit coupling portion 6, and when the cam 30 has rotated further to close the switch 27, full power is supplied directly to the transformer primary. The secondary windings 35, 36 of the transformer 34 provide power to an output circuit 37 for energization of the magnetron 2. The output circuit 37 includes the first secondary winding 35 that provides heater energization in the magnetron, and the second transformer secondary 36 is coupled in a circuit 38 that provides high voltage energization for the magnetron or other suitable power generator.

It is the purpose of the current limiting resistor 33 to reduce current surges and the like in the circuit 1 upon initiating energization of the magnetron in each complete cycle during intermittent operation thereof, thus increasing the life of the magnetron and reducing the possibility of damage to another part of the circuit 1. The current limiting resistor 21 connected in series with the push-button start switch 20 has a similar function to that of the current limiting resistor 33, particularly in the event that the switches 26 and 27 are closed at the time that the push-button start switch 20 is closed. Of course, it will be appreciated that one or both of the resistors 21 and 33 may be eliminated and the control circuit will still effectively control operation of the power generator as previously described. However, if the resistor 33 is eliminated, there is no longer any need for both of the switches 26, 27, one being sufficient.

By adjustment of the selectively actuable means 5, the circuit 1 may be operated in either of two modes to supply, respectively, cyclical intermittent energization of the magnetron 2 in the manner described above, or continuous energization of the magnetron. In the intermittent mode of operation, the selectively actuable means 5, which is illustrated in FIGS. 1 and 2 as a manually rotatable cam 40, 40*a*, respectively, is moved to a position allowing free movement of the cntacts of the switches 26, 27 by the rotating cam 30, and the mechanical linkage 41 between the cam 40 and the normally closed switch 32 maintains such switch closure whenever the cam 40 is in a position to permit free cyclical operation of the switches 26, 27. To obtain continuous energization of the magnetron 2, the cam 40 is manually rotated about its pivotal axis to urge the contacts of the switches 26, 27 to a closed condition so that even if the cam 30 were to continue rotating it would have no influence on the switches 26, 27, which would be locked closed by the cam 40. As an energy conservation measure the linkage 41 may effect opening ofthe switch 32 to de-energize the motor 31 whenever the cam 40 is selectively adjusted to close the switches 26, 27 for continuous, full power energization of the magnetron 2.

In operation of the circuit 1 in its intermittent mode, defrosting of frozen food has been effective when using, for example, a 30 seconds cycle in which the magnetron 2 is energized for approximately 15 seconds of the cycle with current flowing through the current limiting resistor 33 for about one-half second at the beginning of magnetron energization. Thus, the current limiting resistors may be of the low power type since current flow therethrough occurs only briefly in each cycle. It will, however, be appreciated that the total period for one cycle and the duration in that cycle that the magnetron is energized may be varied, as desired, for example, by changing the cam 30 or by changing the rotational speed thereof. It will also be appreciated that although the preferred form of the invention employs the current limiting resistor 33, the resistor, and , therefore, the pair of switch contacts required for coupling the same in the circuit 1 may be eliminated in the event that the current surges upon each start up of the magnetron are of no concern. Likewise, the resistor 21 may be eliminated if found unnecessary for a particular application. Moreover, various mechanical and electronic arrangements may be employed for cyclically driving the switches 26, 27, or the singular switch, if used, and for locking the same for continuous, full power energization of the magnetron, as will be described, for example, in more detail below.

Turning now more specifically to FIG. 2, part of the intermittent operating portion 4*a* of the circuit 1 is illustrated. In FIGS. 2; 3 and 4; 5; and 6 the respective letters suffixes *a* through *d* are used to designate parts corresponding to similar parts, primarily in terms of identity of function, illustrated in and described with reference to FIG. 1 or to another previous figure. The schematically illustrated switches 26, 27 of FIG. 1 are thus represented as a pair of conventional, normally open, single pole, single throw switches 26*a*, 27*a* receiving a common input from the line 24*a*. When the respective actuators 51, 52 of the switches 26*a*, 27*a* are depressed by downward pivotal movement of the respective switch operating levers 53, 54, respective contacts in the switches will be closed to provide closed circuits from the line 24*a* to the current limiting resistor 33*a* first and then around the current limiting resistor via the connection 55 in the manner described above with reference to FIG. 1. The cam 30*a* is rotated on its axial shaft 56 by the motor 31*a*, and as the cam 30*a* rotates it moves the respective switch operating levers 53, 54 first to close switch 26*a*, then to close switch 27*a*, and finally releasing both levers to open both switches, the order of switch opening not being critical to the present invention. However, it will be appreciated that in order to use a resistor 33*a* of a relatively low power rating and correspondingly low expense, it is desirable that the duration of continuous current flow through that resistor be reasonably short, for example, less than about ten seconds, but if longer durations are desired a resistor with an appropriately larger power rating may be employed.

To assure that the switch 26*a* is closed before the switch 27*a*, the latter may be located slightly further from the cam 30*a* than the former, as shown, for example, in FIG. 2, or the cam may have an offset portion to achieve the same staggered switch closing effect. For intermittent energization of the magnetron 2, the cam 40*a* of the selectively operable means 5*a* is manually rotated on its axial shaft 57 by the oven operator manually turning the knob 58 until the raised land 59 on the cam 40*a* is out of the way as in FIG. 2 so that the switch operating levers 53, 54 will be moved cyclically by the rotating cam 30*a* in the manner previously described, However, by manually turning the knob 58, for example, in a counterclockwise direction as illustrated in FIG. 2, the raised land 59 urges the switch operating levers 53, 54 downward to lock the switches 26, 27 in closed condition so that continued rotation of the cam 30*a* will not affect the switches 26*a*, 27*a* and the switches 26*a*, 27*a* will provide continuous power through to the circuit coupling portion 6 and the magnetron 2. The cam 40*a* also may have an offset portion to achieve the described staggered switch closing effect when locking the switches 26, 27 closed.

While the preferred embodiment envisions closure of both switches 26*a*, 27*a* when the cam 40*a* is selectively adjusted to its position for operation of the circuit 1 and the magnetron 2 in the continuous mode, it will be appreciated that the cam 40*a* may be located, for example, to lock closed only one of the two switches 26*a*, 27*a*, or the shaft 57 may be longitudinally movable in its support, now shown, for movement of the cam 40*a* to selected alignment with either one or both of the switch operating levers 53, 54.

Figure 3:
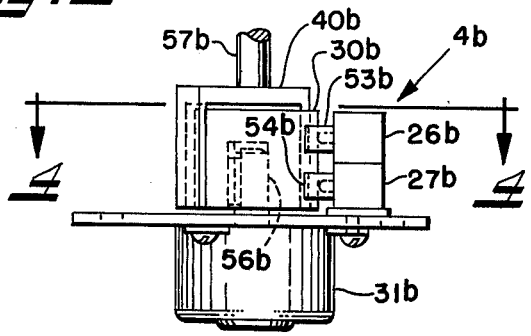
FIG. 3 is a top view of a modified cyclically driven switch mechanism and concentric, overlapping cam lock-out therefor.
Figure 4:
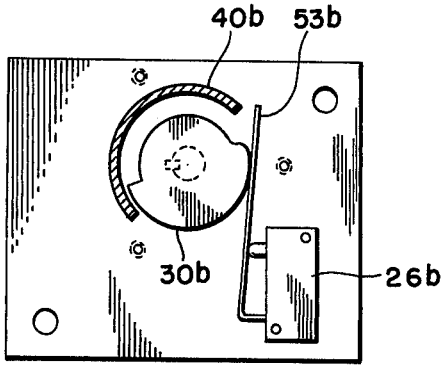
FIG. 4 is a plan view of the modified cyclically driven switch mechanism and cam lock-out therefor looking in the direction of arrows 4—4 of FIG. 3.

Referring now to FIGS. 3 and 4, a portion of a further modified intermittent operating portion 4*b* is shown and includes concentrically positioned, overlapping cams 30*b*, 40*b* for operating the two switches 26*b*, 27*b*, which correspond to the switches 26, 27 and 26*a*, 27*a* described above, respectively, with reference to FIGS. 1 and 2. The cam 30*b* rotated on its shaft 56*b* by the motor 31*b* moves the respective switches operating levers 53*b*, 54*b* to obtain sequential and cyclical operation of the switches 26*b*, 27*b* in the manner described above, for example, with reference to FIGS. 1 and 2. The cam 40*b*, which is mounted for manual rotation on its shaft 57*b*, preferably is in the form of a half or otherwise incomplete cylinder concentric about part of the cam 30*b*. When the cam 40*b* is manually rotated so that its open or discontinuous part is facing the switch operating levers 53*b*, 54*b*, the switches 26*b*, 27*b* will be cyclically operated in the manner described by the rotating cam 30*b*. However, when the cam 40*b* is rotated on its shaft 57*b* such that its solid exterior cylindrical surface abuts the switch operating levers 53*b*, 54*b*, the switches 26*b*, 27*b* will be locked closed for continuous, full power energization of the magnetron 2, as described above. Moreover, the surface of cam 40*b* may be designed in a manner similar to that described above to have multiple angular positions allowing, in a first instance, the switches to be operated solely by the rotating cam 30*b*, in a second instance to lock both switches closed, and in respective third and fourth instances to lock one or the other of the switches closed, while the cam 30*b* may or may not be rotating; therefore, full and various intermediate power outputs from the magnetron 2 may be obtained.

Figure 5:
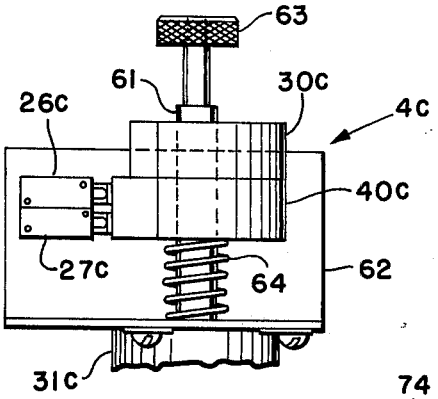
FIG. 5 is a view of another modified cyclically driven switch mechanism and a concentric, spaced-apart cam lock-out therefor.

In FIG. 5 part of another intermittent operating portion 4*c* is illustrated, including a pair of switches 26*c*, 27*c* and a pair of cams 30*c*, 40*c*. The cams 30*c*, 40*c* are concentrically mounted in axial relation to each other along a common shaft 61 that is supported in a mounting 62 within the body of a microwave oven, not shown, and a motor 31*c* rotates the common shaft 61, and, thus, the cams 30*c*, 40*c*. If desired, the cams 30*c*, 40*c* may be formed as a single integral piece. The shaft 61 is longitudinally movable in its support mounting 62 so that in one relative longitudinal position of the shaft 61 the cam 30*c* will be aligned for cyclical operation of the switches 26*c*, 27*c* as the motor 31*c* rotates in the manner described above. However, by longitudinally moving the knob 63 attached to the shaft 61, the shaft 61 may be moved to another relative longitudinal position to bring the cam 40*c* into alignment with the respective switch operating levers of the switches 26*c*, 27*c*, to lock those switches in closed condition for continuous full power energization of the magnetron 2. A spring 64 provides a bias force to urge the shaft 61 to a normal position, and lock means, not shown, may be employed to retain the shaft in either selected longitudinal position. Moreover, the coupling between the motor 31*c* and the shaft 61 may be separable or fixed, respectively to provide for disconnection from the shaft 61 when the latter is pulled to lock-out the switches 26*c*, 27*c*, or to provide continued shaft rotation regardless of the shaft longitudinal position.

Figure 6:
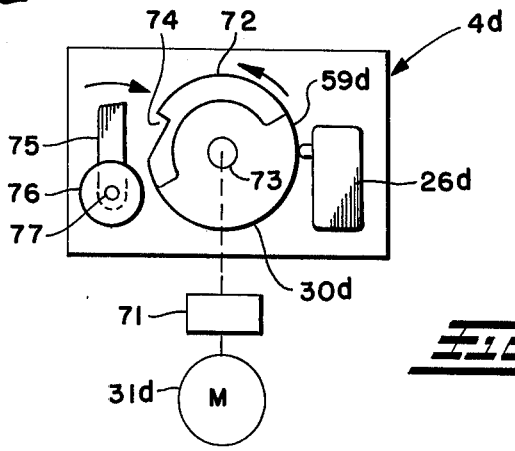
FIG. 6 is an isometric view of a further modified cyclically driven switch mechanism and a clutch slipping mechanical lock-out therefor.

In the embodiment of the intermittent operating portion 4*d* illustrated in FIG. 6, the switches, only switch 26*d* being seen, are operated cyclically or are locked closed by a single cam 30*d*, which is connected by a conventional slip clutch mechanism 71 to the motor 31*d*. As the motor 31*d* rotates the cam 30*d* via the clutch mechanism 71, the high portion or land 59*d* of the cam 30*d* will close the respective switches for a duration in each rotational cycle thereof. Beneath the cam 30*d* is another circular member 72 mounted on the same shaft 73 and the member 72 has a locking notch 74 therein positioned to be engaged by a selectively adjustable pivotable locking stop 75 that may be manually operated by a knob 76 connected thereto via a shaft 77. To obtain continuous energization of the magnetron 2, the stop 75 is pivoted toward the rotating member 72, and when the notch 74 and the stop 75 align the latter locks the former to stop the cam 30*d* rotation at an angular position such that the high surface 59*d* locks the switches in closed condition. While the cam 30*d* is in such locked condition, the clutch mechanism 71 will slip allowing the motor 31*d* to continue rotating as the cam 30*d* maintains the switches locked closed.

While the invention is illustrated and described above with reference to normally open switches that are closed by the respective cams or the like to effect magnetron energization, it will be appreciated that normally closed switches may be equivalently used with the cams either allowing the switches to remain closed or acting on them to open the same.

It should now be clear that the present invention provides a selectively operable lock to obtain a continuous output from an otherwise normally cycling electric circuit for energization of a magnetron either in intermittent mode using one or more cyclically driven switches or in continuous mode by locking-out closed those same switches.

The embodiments of the invention in which an exclusive property or privilege is claimed are defined as follows:

1. A circuit for selectively supplying continuous and intermittent input energy to an electric apparatus that produces an output in response to the input energy thereto, comprising:

means for connecting the circuit to an electric energy source, coupling means for coupling energy in the circuit to the electric apparatus, switch means operable in a first condition for providing energy in the circuit to said coupling means and in a second condition for interrupting the flow of energy to said coupling means, electrically powered switch operating means for cyclically operating said switch means to such respective conditions to provide intermittently energy in the circuit to said coupling means, and selectively operable means for selectively locking said switch means in such first condition independently of said switch operating means to provide uninterrupted energy in the circuit to said coupling means as long as said switch means is selectively locked in such first condition by said selectively operable means.

2. A circuit as set forth in claim 1, said switch operating means comprising a motor and cam means driven by said motor for cyclically opening and closing said switch means to such respective conditions.

3. A circuit as set forth in claim 2, said selectively operable means comprising further cam means adjustable to one position relative to said switch means permitting the latter to by cyclically operated by said switch operating means and to another position for locking closed said switch means.

4. A circuit as set forth in claim 3, further comprising respective parallel positioned shaft means for supporting said cam means and said further cam means in substantially co-planar, spaced-apart position.

5. A circuit as set forth in claim 3, further comprising means for mounting said further cam means substantially concentrically about a portion of said cam means and rotatable at least partially thereabout.

6. A circuit as set forth in claim 3, further comprising means for mounting said cam means and said further cam means in relatively adjacent position concentrically about a common linear axis.

7. A circuit as set forth in claim 2, further comprising slip clutch means for connecting the mechanical output from said motor to move said cam means, and said selectively operable means comprising stop means for selectively stopping rotation of said cam means at a position to lock closed said switch means, said slip clutch means permitting continuous operation of said motor while said cam means is held against rotation by said stop means.

8. A circuit as set forth in claim 1, said selectively operable means comprising further cam means adjustable to one position relative to said switch means permitting the latter to by cyclically operated by said switch operating means and to another position for locking closed said switch means.

9. A circuit as set forth in claim 1, wherein the electric apparatus includes a magnetron for producing a microwave energy output in response to an input energy supply, said coupling means comprising a transformer for coupling electric energy in the circuit to such magnetron.

10. A circuit as set forth in claim 9, further comprising timer means for controlling the duration of circuit operation to energize the magnetron.

11. A circuit as set forth in claim 10, said switch operating means comprising a motor and cam means driven by said motor for cyclically opening and closing said switch means to such respective conditions.

12. A circuit as set forth in claim 10, said selectively operable means comprising further cam means adjustable to one position relative to said switch means permitting the latter to be cyclically operated by said switch operating means and to another position for locking closed said switch means.

13. A circuit as set forth in claim 11, further comprising slip clutch means for connecting the mechanical output from said motor to move said cam means, and said selectively operable means comprising stop means for stopping rotation of said cam means at a position to lock closed said switch means while the stopped cam means and the mechanical output from said motor effect slipping of said clutch means.

14. A circuit as set forth in claim 1, said switch means comprising a first switch, current limiting means connected in series with said first switch for limiting the current through said first switch, and a second switch connected in parallel across said first switch and said current limiting means, said switch operating means normally being operable to close said first switch prior to closing said second switch in each cyclical operation of said switch means.

15. A circuit as set forth in claim 14, said selectively operable means comprising means for locking closed both said first and second switches.

* * * * *